US010971827B2

(12) United States Patent
Zseli

(10) Patent No.: US 10,971,827 B2
(45) Date of Patent: Apr. 6, 2021

(54) CRIMP INTERCONNECT DEVICE, CRIMPED ARRANGEMENT AND METHOD FOR MAKING A CRIMPED ARRANGEMENT

(71) Applicant: TDK Electronics AG, Munich (DE)

(72) Inventor: Szabolcs Zseli, Fertöszentmiklós (HU)

(73) Assignee: TDK ELECTRONICS AG, Munich (DE)

( * ) Notice: Subject to any disclaimer, the term of this patent is extended or adjusted under 35 U.S.C. 154(b) by 0 days.

(21) Appl. No.: 16/471,283

(22) PCT Filed: Sep. 28, 2018

(86) PCT No.: PCT/EP2018/076474
§ 371 (c)(1),
(2) Date: Jun. 19, 2019

(87) PCT Pub. No.: WO2019/068584
PCT Pub. Date: Apr. 11, 2019

(65) Prior Publication Data

US 2020/0091623 A1 Mar. 19, 2020

(30) Foreign Application Priority Data

Oct. 6, 2017 (DE) ..... 10 2017 123 286.9

(51) Int. Cl.
*H01R 4/20* (2006.01)
*H01R 4/62* (2006.01)
*H01R 43/048* (2006.01)

(52) U.S. Cl.
CPC ..... *H01R 4/20* (2013.01); *H01R 4/62* (2013.01); *H01R 43/048* (2013.01)

(58) Field of Classification Search
CPC ..... H01R 4/20
USPC ..... 174/84 C
See application file for complete search history.

(56) References Cited

U.S. PATENT DOCUMENTS

| | | | | |
|---|---|---|---|---|
| 2,815,497 | A * | 12/1957 | Redslob | H01R 4/62 439/203 |
| 3,200,190 | A | 8/1965 | Forney, Jr. | |
| 3,744,006 | A * | 7/1973 | O'Loughlin | H01R 4/50 439/393 |
| 3,955,044 | A | 5/1976 | Hoffman et al. | |
| 5,504,275 | A * | 4/1996 | Scramoncin | H01R 4/187 174/84 C |
| 2004/0053542 | A1 | 3/2004 | Gloaguen et al. | |
| 2004/0137801 | A1* | 7/2004 | Quillet | H01R 4/183 439/877 |
| 2008/0189940 | A1* | 8/2008 | Tyler | H01B 11/1008 29/828 |

(Continued)

FOREIGN PATENT DOCUMENTS

| | | | |
|---|---|---|---|
| DE | 388364 | A | 1/1924 |
| DE | 1515419 | B | 11/1969 |

(Continued)

*Primary Examiner* — Chau N Nguyen
(74) *Attorney, Agent, or Firm* — Slater Matsil, LLP

(57) ABSTRACT

A crimp interconnect device, a crimped arrangement and a method for making a crimped arrangement are disclosed. In an embodiment a crimp interconnect device includes a deformable barrel body having an inner side and an outer side and a first material, and a second material that is softer than the first material, wherein the second material is arranged on the inner side.

9 Claims, 2 Drawing Sheets

(56) References Cited

U.S. PATENT DOCUMENTS

| | | | | |
|---|---|---|---|---|
| 2014/0224536 | A1* | 8/2014 | Ito | H01R 4/184<br>174/84 C |
| 2015/0096159 | A1* | 4/2015 | Cawood | H01R 4/183<br>29/235 |
| 2015/0333415 | A1* | 11/2015 | Takahashi | H01R 4/185<br>174/74 R |

FOREIGN PATENT DOCUMENTS

| | | | |
|---|---|---|---|
| DE | 1565959 | A | 4/1970 |
| DE | 1665504 | A | 3/1971 |
| EP | 2673843 | B1 | 3/2016 |
| GB | 836587 | A | 6/1960 |
| GB | 958644 | * | 5/1964 |
| JP | S5493490 | A | 7/1979 |
| JP | 3144604 | U | 9/2008 |
| JP | 2009009736 | A | 1/2009 |

* cited by examiner

-Prior Art-

CRIMP INTERCONNECT DEVICE, CRIMPED ARRANGEMENT AND METHOD FOR MAKING A CRIMPED ARRANGEMENT

This patent application is a national phase filing under section 371 of PCT/EP2018/076474, filed Sep. 28, 2018, which claims the priority of German patent application 102017123286.9, filed Oct. 6, 2017, each of which is incorporated herein by reference in its entirety.

TECHNICAL FIELD

The invention relates to a crimp interconnect device, a crimped arrangement including such a crimp interconnect device and a method for making a crimped arrangement.

BACKGROUND

Crimping allows connecting two pieces of ductile material by deforming at least one of them. A ductile material is a solid material having the ability to deform under mechanical or tensile stress. Crimping may be used to form a connection between a crimp interconnect device, also referred to as a crimp electrical interconnect device, and one or more conductors, which may be wires. The wires are inserted into a barrel of the interconnect device. Then the barrel is deformed in such a manner that it holds the wires. The deformation is called crimp. The crimp interconnect device may have a contact area to be connected to other parts or may be ring-shaped having a barrel function, which allows inserting wires from either side and connecting the crimp interconnect device to the wires on either side. Such interconnect devices may be referred to as slices. A simple embodiment of a slice is a press ring having a sleeve-shaped form.

If mechanically crimping together materials of different mechanical hardness, the softer material reduces its cross section during the crimping process. In other words, if crimping together a conductor made of one material and another one made of a softer material, the softer material is deformed more, thereby reducing the cross-section of the conductor made of the softer material. Due to cross-section reduction the electrical conductivity and the mechanical stability of the joint may be deteriorated, which may cause a high risk of overheating the joint due to electric overload and of mechanical breaking due to vibrations. If crimping together a solid aluminum wire and a solid copper wire, the above-mentioned problems would arise.

When crimping together a solid aluminum wire and a solid copper wire, the cross section of the copper, which is the harder material, does not change, while the one of the aluminum, which is the softer material, does. In the case of a cross section of 40 $mm^2$ it may be reduced to 16 $mm^2$ by the crimping process. Conventional press rings involve the above-mentioned problem and are not suitable for crimping together aluminum and copper in a proper way.

SUMMARY OF THE INVENTION

Embodiments provide an improved crimped arrangement and a suitable crimp interconnect device for forming such a crimped arrangement.

The crimp interconnect device comprises a deformable barrel body having an inner side and an outer side and being made of a first material, whereas a second material that is softer than the first material is arranged on the inner side.

The crimp interconnect device, which may also be referred to as electrical crimp interconnect device, comprises a barrel that can be connected to at least one conductor, e.g., a wire, by crimping and may comprise a connection area to be connected to a mating part, e.g., by means of screwing the connection area to the mating part. The barrel body and the second material applied thereon form the barrel. Nevertheless, the second material does not need to touch the first material; a layer of a different material may be provided between the two. The barrel body and the connection area may be formed as a single piece. The crimp interconnect device may be embodied as a press ring having no connection area but allows connecting several wires after inserting them into the press ring.

The crimp interconnect device allows crimping together materials of different hardness to one common joint in order to prevent the softer material from cross-section reduction during mechanical crimping. The second material, which may be referred to as an additional material with respect to a conventional crimp interconnect device, flows between the barrel body and the pressed wires.

In one embodiment a layer of the second material is arranged on the inner side, or an inner sleeve made of the second material is arranged inside the barrel body. The second material may also be arranged on the outer side. Such a crimp interconnect device may be manufactured by covering the whole barrel body, e.g., made of copper, with a thin layer and then applying an additional, thicker layer on the inner side. The second material arranged on the inner side has a width that is larger than a width of a layer of the second material that is arranged on the outer side.

The second material may be tin, which may be easily deformed at room temperature. The barrel body may be a sleeve having an optional chamfer, which provides good stability. The barrel body may be made of copper.

The above-mentioned crimp interconnect device may be used in a crimped arrangement comprising the crimp interconnect device being crimped to a plurality of conductors. The conductors may be single-strand wires, also called solid wires, or multi-strand wires, also referred to as litz wires, or a combination thereof. The second material is less hard than the softer crimped conductors. Therefore the second material additionally added to a crimp interconnect device's barrel body prevents mechanical deformation of the crimped pmts. It is not necessary to use expensive connection parts between the aluminum and copper wires. Crimping is made possible by means of one press ring forming the crimp interconnect device.

The plurality of conductors is at least partly located in the barrel body being deformed by a crimp, which forms a strong connection between the crimp interconnect device and the conductors.

The plurality of conductors comprises at least one conductor made of a third material and at least one conductor made of a fourth material differing from the third material. The second material is softer than the third and fourth materials. Thus the strongest deformation occurs in the second material, causing less deformation of the conductors made of the third and fourth materials.

The first material and either the third material or the fourth material may be the same material. In other words, the barrel body and some wires are made or copper, for example. In such a case the third material may comprise copper and the fourth material may comprise aluminum, or vice versa.

A method for forming a crimped arrangement as mentioned above comprises inserting a plurality of conductors into a deformable barrel of the crimp interconnect device and deforming the barrel in such a manner that the plurality of conductors and the barrel are connected and the second material flows into a void between the barrel and at least one of the plurality of conductors.

BRIEF DESCRIPTION OF THE DRAWINGS

Non-limiting, exemplary embodiments of the invention will now be described with reference to the accompanying drawings, in which.

DETAILED DESCRIPTION OF ILLUSTRATIVE EMBODIMENTS

Figure 1:
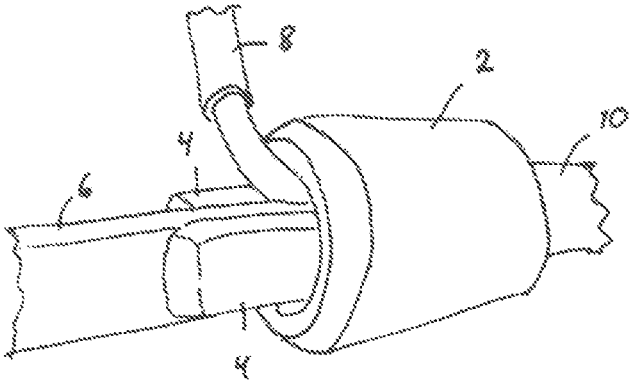
FIG. 1 shows a three-dimensional view of an embodiment of a crimped arrangement connecting several conductors.

FIG. 1 shows a three-dimensional view of an embodiment of a crimped arrangement connecting several conductors. The arrangement comprises a crimp interconnect device including a barrel, which is embodied as a press ring 2 connecting two aluminum wires 4, a copper wire 6 and a soft copper wire 8 having a stripped end to a further wire 10. The aluminum wires 4, the copper wire 6 and the soft copper wire 8 have been inserted into one end of the press ring 2; the further wire 10 has been inserted into the other end of the press ring 2. The press ring 2 is deformed by an indent crimp 22 (not visible in FIG. 1), which forms a connection of the wires 4, 6, 8, 10 and the press ring 2. A single indent crimp 22 may be formed by an indentor ram, which causes a crescent cross-section deformation. The barrel 12 may be deformed by a suitable means, e.g., a hand tool or an automatic wire processing system.

Figure 2:
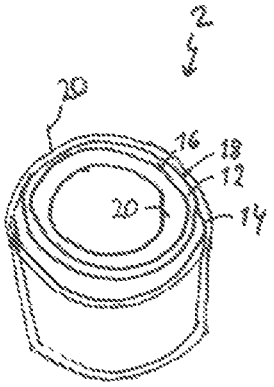
FIG. 2 shows an embodiment of a crimp interconnect device.

FIG. 2 shows an embodiment of a crimp interconnect device being a press ring 2. It comprises a barrel body 12, also referred to as a press ring body, having a sleeve-shaped form with a chamfered edge 14. The barrel body 12 has an inner side 16 and an outer side 18 and is made of a first material, which may be copper. A second material is applied to the inner side 16 of the barrel body 12.

The press ring 2 is adapted to hold the conductors 4, 6, 8, 10 after mechanical deformation of the press ring 2, which forms the crimp connection. The press ring body 12 may be made from an ordinary copper pipe. During pipe cutting, a cutter forms small flanges or chamfers 14 in order to provide stronger mechanical stability for the press ring 2. Then the press ring body 12 is over-tinned and filled with tin 20, thereby adding a tin layer 20 of 1-2 mm width to the inner side 16 of the press ring body 12.

In an alternative embodiment, a sleeve made of the second material, e.g. tin, is inserted into the sleeve-shaped barrel body 12. The second material 20 is softer than the first material and the material the conductors 4, 6, 8, 10 are made of.

Figure 3:
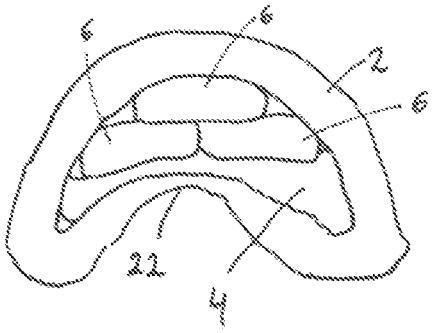
FIG. 3 shows a cross-sectional view of a crimped conventional press ring.

The use of additional material 20 between the press ring body 12 and the pressed wires 4, 6, 8, 10 prevents cross-sectional reduction of at least the softest wire. FIG. 3 shows a cross-sectional view of a crimped conventional press ring 2 connecting copper wires 6 and an aluminum wire 4. Since aluminum is softer than copper, crimping has the strongest impact on the aluminum wire 4. The aluminum cross section has been reduced from 40 $mm^2$ to 16 $mm^2$.

The press ring 2 described in connection with FIG. 2 allows crimping together materials of different hardness in one common joint, wherein a cross-section reduction of the softer material is prevented during mechanical crimping. Since the second material is softer than the conductors, the strongest deformation impact occurs on the second material. In other words, since tin is softer than aluminum and copper, crimping has the strongest deformation impact on the tin 20 arranged inside the barrel body 12. The tin material flows into voids between the ring sleeve 2 and the conductors 4, 6, 8, 10, thereby reducing conductor deformation.

Figure 4:
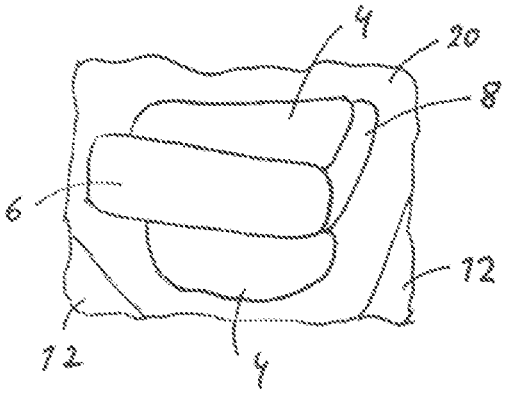
FIG. 4 shows a detailed sectional view of a crimped connection.

FIG. 4 shows a detailed sectional view of a crimped connection between the press ring 2 described in connection with FIG. 2 and the aluminum wires 4, the soft copper wire 8 and the copper wire 6 as described in connection with FIG. 1. The tin layer 20 located inside the press ring body 12 has been flown towards the conductors 4, 6, 8, which are significantly less deformed than in FIG. 3. The tin filling 20 of the press ring 2 having a proper thickness prevents mechanical cross-section reduction of the softer aluminum wires 4. The described technology allows crimping together aluminum and copper or any other combination of materials having different hardness by applying mechanical force without cross-section reduction of the softer material. Hardness in Vickers of the materials is: aluminum 160, copper 345, lead-free tin max. 40.

The above-mentioned crimp interconnect device 2 having a tin layer 20 inside allows to form connections between different material combinations. Copper-copper-connections can be formed, wherein the barrel body 12 as well as the conductors 4, 6, 8, 10 are made of copper. Copper-aluminum-connections can be formed, wherein one of the barrel body 12 and the conductors 4, 6, 8, 10 is made of copper; another one is made of aluminum. Aluminum-aluminum-connections can be formed, wherein the barrel body 12 as well as the conductors 4, 6, 8, 10 are made of aluminum. The crimp interconnect device 2 may also be suitable for connecting different wires, e.g., a solid wire to a solid wire, or a solid wire to a solid wire and a litz wire, or a solid wire to a litz wire.

The scope of protection is not limited to the examples given herein above. The invention is embodied in each novel characteristic and each combination of characteristics, which particularly includes every combination of any features which are stated in the claims, even if this feature or this combination of features is not explicitly stated in the claims or in the examples.

The invention claimed is:

1. A crimped arrangement comprising:

a crimp interconnect device comprising:

a deformable barrel body having an inner side and an outer side and being made of a first material; and a second material that is softer than the first material, the second material being arranged on the inner side and the outer side, wherein the crimp interconnect device is crimped to a plurality of conductors, the plurality of conductors comprising at least one conductor made of a third material and at least one conductor made of a fourth material differing from the third material, wherein the second material is tin with a thickness of 1-2 mm on the inner side, wherein the thickness of the second material arranged on the inner side is larger than a thickness of a layer of the second material arranged on the outer side, and wherein the first material is copper.

2. The crimp arrangement according to claim 1, wherein an inner sleeve made of the second material is arranged inside the barrel body.

3. The crimp arrangement according to claim 1, wherein the barrel body is sleeve-shaped.

4. The crimp arrangement according to claim 1, wherein the barrel body has a chamfer.

5. The crimped arrangement according to claim 1, wherein the first material and either the third material or the fourth material are the same material.

6. The crimped arrangement according to claim 1, wherein the third material comprises copper and the fourth material comprises aluminum.

7. A method for making the crimped arrangement according to claim 1, the method comprising:

inserting the plurality of conductors into the barrel body of the crimp interconnect device, the plurality of conductors comprising the at least one conductor made of the third material and the at least one conductor made of the fourth material differing from the third material;

deforming the barrel body such that the plurality of conductors and the barrel body are connected; and flowing the second material into a void between the barrel body and at least one of the plurality of conductors.

8. The method according to claim 7, wherein the first material and either the third material or the fourth material are the same material.

9. The method according to claim 7, wherein the third material comprises copper and the fourth material comprises aluminum.

* * * * *